US011425807B2

(12) United States Patent
Chen et al.

(10) Patent No.: US 11,425,807 B2
(45) Date of Patent: Aug. 23, 2022

(54) LED LIGHTING CIRCUIT AND A LIGHTING DEVICE COMPRISING THE SAME

(71) Applicant: SIGNIFY HOLDING B.V., Eindhoven (NL)

(72) Inventors: Zhi Quan Chen, Shanghai (CN); John Dai, Shanghai (CN); Liang Shi, Shanghai (CN); Kelvin Wang, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/274,698

(22) PCT Filed: Sep. 3, 2019

(86) PCT No.: PCT/EP2019/073386
§ 371 (c)(1),
(2) Date: Mar. 9, 2021

(87) PCT Pub. No.: WO2020/053024
PCT Pub. Date: Mar. 19, 2020

(65) Prior Publication Data

US 2022/0053622 A1 Feb. 17, 2022

(30) Foreign Application Priority Data

Sep. 11, 2018 (WO) ..... PCT/CN2018/105114
Nov. 5, 2018 (EP) ..... 18204436

(51) Int. Cl.
*H05B 45/48* (2020.01)
*H05B 45/54* (2020.01)

(52) U.S. Cl.
CPC ..... *H05B 45/48* (2020.01); *H05B 45/54* (2020.01)

(58) Field of Classification Search
CPC ..... H05B 45/00; H05B 45/30; H05B 45/34; H05B 45/40; H05B 45/46; H05B 45/48; H05B 45/54
See application file for complete search history.

(56) References Cited

U.S. PATENT DOCUMENTS 5,828,562 A * 10/1998 Rivet ..... H02M 1/4208 363/125
9,295,117 B2 3/2016 Acatrinei
(Continued)

FOREIGN PATENT DOCUMENTS

CN 102427633 B 3/2013
DE 102017200490 B3 2/2018
(Continued)

*Primary Examiner* — Thai Pham
(74) *Attorney, Agent, or Firm* — Daniel J. Piotrowski

(57) ABSTRACT

In order to reduce energy loss of a tapped linear driver, it is proposed an LED lighting circuit, comprising an input (Vbus, GND) adapted to receive an input voltage, a plurality of LED segments (LED1, LED2, LED3, LED) connected in series and to the input, a buffer component (C9) connected to an anode and a cathode of a series string of at least two of the plurality of LED segments with respective switches, a current source circuit (B1) in series connection with a parallel connection of the buffer component (C9) and the at least two LED segments, across the input; further comprising a further buffer component (C5) across the current source circuit (B1), wherein said buffer component (C9) and the further buffer component (C5) is in series connection.

10 Claims, 6 Drawing Sheets

(56) References Cited

U.S. PATENT DOCUMENTS

| | | | | |
|---|---|---|---|---|
| 10,542,594 | B2 * | 1/2020 | Lin | H05B 45/375 |
| 2010/0134018 | A1 * | 6/2010 | Tziony | H05B 45/10 315/122 |
| 2011/0121741 | A1 * | 5/2011 | Yamamoto | G09G 3/3406 315/193 |
| 2011/0199003 | A1 * | 8/2011 | Muguruma | H05B 45/44 315/122 |
| 2013/0307424 | A1 * | 11/2013 | Gray | H05B 45/48 315/193 |
| 2015/0108909 | A1 * | 4/2015 | Rupp | H05B 45/3725 315/188 |
| 2016/0278171 | A1 * | 9/2016 | Jermyn | H05B 45/10 |
| 2017/0099708 | A1 * | 4/2017 | Lynch | H02M 1/14 |
| 2017/0332448 | A1 * | 11/2017 | Lookman | H05B 45/50 |

FOREIGN PATENT DOCUMENTS

| | | | |
|---|---|---|---|
| EP | 2187705 | A1 | 5/2010 |
| JP | 2017135086 | A | 8/2017 |
| WO | 2009013676 | A2 | 1/2009 |
| WO | 2009029553 | A2 | 3/2009 |
| WO | 2017012835 | A1 | 1/2017 |

* cited by examiner

LED LIGHTING CIRCUIT AND A LIGHTING DEVICE COMPRISING THE SAME

CROSS-REFERENCE TO PRIOR APPLICATIONS

This application is the U.S. National Phase application under 35 U.S.C. § 371 of International Application No. PCT/EP2019/073386, filed on Sep. 3, 2019, which claims the benefit of International Patent Application No. PCT/CN2018/105114, filed on Sep. 11, 2018 and European Patent Application No. 18204436.2. These applications are hereby incorporated by reference herein.

FIELD OF THE INVENTION

This invention relates to a LED lighting circuit.

BACKGROUND OF THE INVENTION

Tapped linear driver, or called as stepped LED driver, is a low cost LED driving technology that does not need a switched mode power supply. It dynamically bypasses one or more LED segment in a series connection of LED segments such that the forward voltage of the rest LED segments in the electrical loop matches the amplitude of the input voltage. The input voltage is usually the AC mains voltage. US20150108909A1 discloses such a tapped linear driver. Even further, it bypasses the LED segment in a binary manner. More specifically, taking the three segments' state as a 3-bit binary code, each segment corresponding to one bit, 1 means one segment is not bypassed and 0 means that segment is bypassed, the three segments are switched as 000, 001, 010, 011, 100, 101, 110 and 111.

SUMMARY OF THE INVENTION

A basic idea of embodiments of the invention is clamping the voltage of the switches to avoid current spikes, via a buffer component that is connected to an anode and a cathode of a series string of at least two LED segments. A discharge of the buffer component still flows through on LED segment to prevent power loss. Preferably, the buffer component also clamps the voltage of a current source circuit. Another basic idea of the embodiments of the invention is providing a circuit with robust surge protection, by using buffer components respectively in parallel with LEDs and with a current source for the LEDs.

According to a basic embodiment, it is provided an LED lighting circuit, comprising an input adapted to receive an input voltage, a plurality of LED segments connected in series and to the input, a buffer component connected to an anode and a cathode of a series string of at least two of the plurality of LED segments with respective switches, a current source circuit in series connection with a parallel connection of the buffer component and the at least two LED segments, across the input; further comprising a further buffer component across the current source circuit, wherein said buffer component and the further buffer component is in series connection.

This embodiment further improves the efficiency, EMI margin and THD. The efficiency can be increased by around 5% than the known circuit, EMI margin is 20 dB and THD is 3%. It can also mitigate surge risk to the LED and to the current source, since the buffer component can also shunt the surge current to the ground (another polarity of the input). Thus a double function of the two buffer components is provided.

In a further embodiment, said buffer component comprises a capacitor, said capacitor is adapted to buffer a voltage across the at least two LED segments when the switches of the at least two LED segment are open, and discharge via one switch of one LED segment and the other LED segment when the switch of the one LED segment closes while the switch of the other LED segment is still open.

This embodiment further defines the operation of the buffer component in reducing the input current spike.

In a further embodiment, it further a switching arrangement comprising a plurality of switches (Q1, Q2, Q3, Q4) each of which is in parallel with a respective LED segment to selectively bypass none or at least one LED segment so as to match the forward voltage of the rest of the plurality of LED segments with an instantaneous amplitude of the input voltage.

In this embodiment, a tapped linear driver (switched segments) topology is used. The voltage change will not be applied to the current source circuit, and there is less input current spikes.

In a further embodiment, said buffer component is adapted to stabilize a voltage across the at least two LED segments, thereby stabilizing a voltage across the current source circuit, when a switch of the at least two LED segments is switched.

This embodiment further defines the operation of the buffer component in reducing the input current spike.

In a further embodiment, the input comprises a positive terminal to connect an anode of the series plurality of LED segments, and a negative terminal to connect, via the current source circuit, a cathode of the series plurality of LED segments, and the buffer component is connected across the anode and the cathode of the series plurality of LED segments.

In this embodiment, the buffer component is connected across the whole series plurality of LED segments.

Alternatively, the buffer component can connect to a series connection of only a subset LED segments of the plurality of LED segments.

And it further comprises a diode forwarded from the cathode of the series plurality of LED segments to an interconnection of said buffer component and the further buffer component.

In a further embodiment, it further comprises a plurality of capacitors each of which is in parallel with one LED segment respectively, and a plurality of diodes each of which is between one switch and one capacitor to block a discharge of the capacitor via the switch such that the current flowing terminals of the switch is decoupled from discharging energy of that parallel capacitor.

Those capacitors further reduce flicker of the LED segments.

In a further embodiment, the input is adapted to receive a rectified AC mains voltage as the input voltage. The AC mains voltage may be 110V AC in the US or Japan, or 220/230V AC in Europe and China.

In a further embodiment, said switching arrangement is adapted to: not bypass a first LED segment and bypass a second LED segment when the instantaneous amplitude of the input voltage is in a first range; bypass the first LED segment and not bypass the second LED segment when the instantaneous amplitude of the input voltage is in a second range higher than the first range; and not bypass the first LED segment and the second LED segment when the instantaneous amplitude of the input voltage is in a third range higher than the second range.

This embodiment provides an application of the basic embodiment in binary tapped linear. Alternatively, the basic embodiment can also be used with normal tapped linear driver wherein the LED segments are turned on/off progressively/accumulatively in a manner of 001, 011, and 111 wherein three bits indicates the state of a respective LED segment.

Another aspect of the invention provides a lighting device comprising the LED lighting circuit according to the above embodiment. The lighting device could be preferably a road light.

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

The invention will be described with reference to the Figures.

Figure 1:
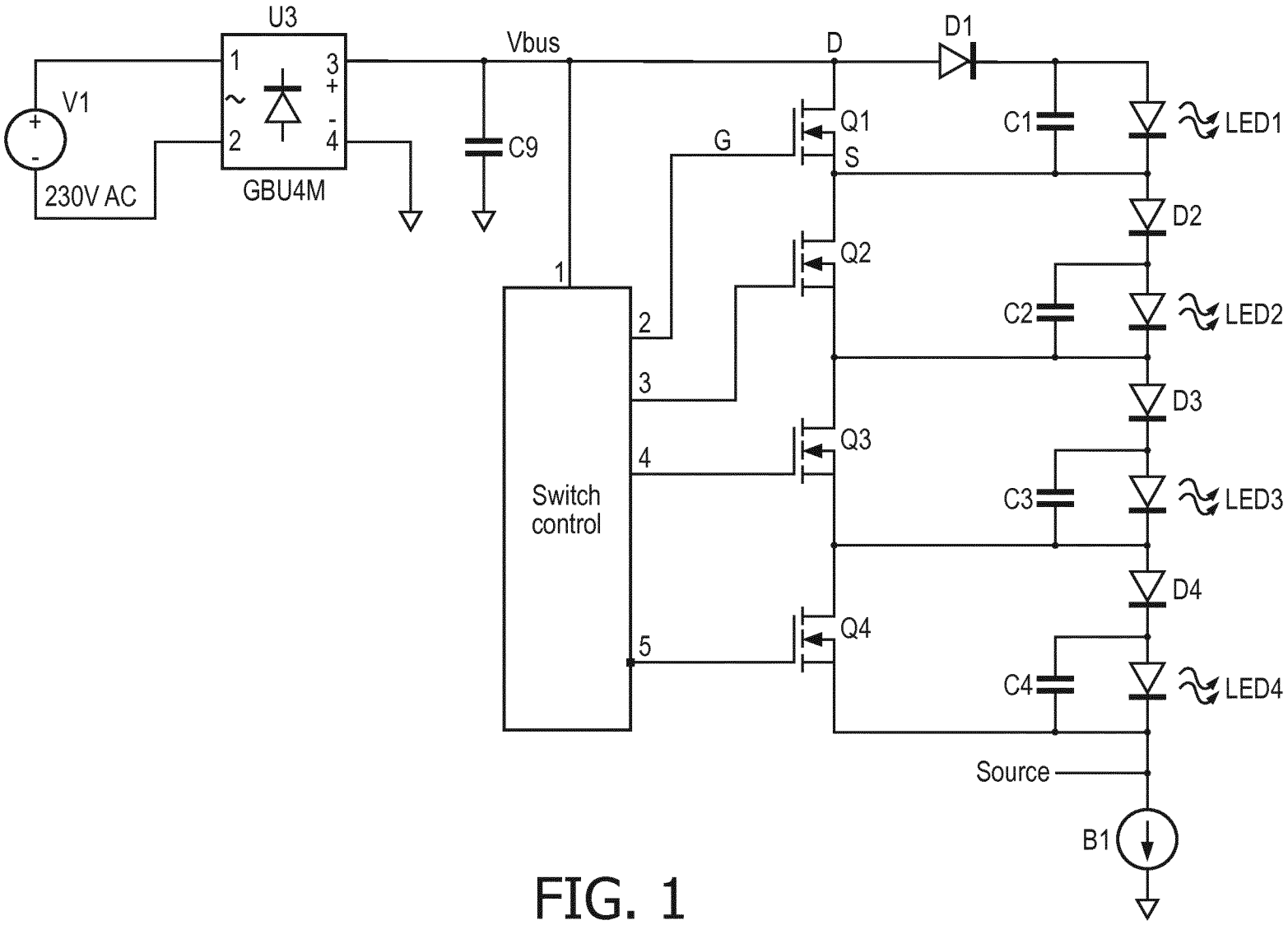
FIG. 1 shows a circuit schematic of a typical tapped linear driver.

FIG. 1 shows a typical circuit schematic of a tapped linear driver. V1 stands for the input voltage which is for example a 230V RMS AC voltage. U3 stands for a rectifier bridge which may be diode based. Alternatively the rectifier bridge could be based on active rectifying implemented by active switches like bipolar transistors or MOSFETs. C9 is a large buffering capacitor connected to the positive output and negative output of the rectifier, for providing a certain buffering. LED1 to LED4 stands for the switched LED segments, while MOSFET S1 to S4 are in parallel with the LED1 to LED4 respectively for bypassing one LED segment or not. Those MOSFETs are driven by a switch control block which could be an IC or is implemented by discrete components. A current source circuit B1 connects in series with the LED segments, and the current source circuit B1 and the LED segments connect to the positive output and negative output of the rectifier. Each LED segment is with a buffer capacitor C1 to C4. Block diode D1 to D4 are connected between the MOSFET and the buffer capacitor to prevent the buffer capacitor from discharging through the MOSFET.

Figure 2:
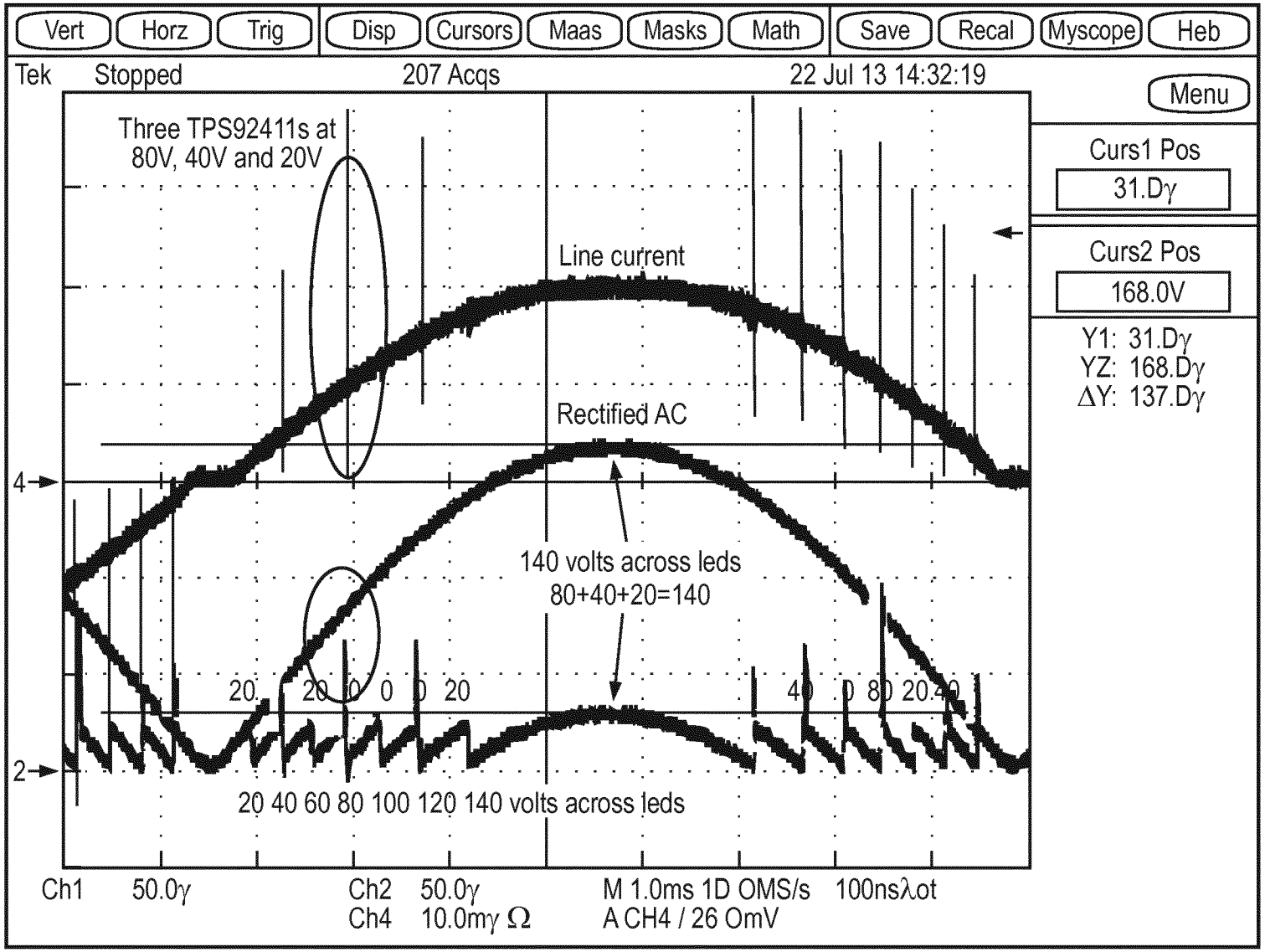
FIG. 2 shows the input current waveform of the circuit in FIG. 1.

During switching period, there is high dv/dt on switching MOSFET Q1~Q4. As the rectified input voltage (between Vbus and GND) at the time of switching considered to be constant, there will be big voltage spike on current source circuit B1 which made EMI poor. Also since the impedance of the current source circuit B1 is slowly responsive, high spike in input current is caused which made THD worse and also produces some noise due to circuit oscillating. FIG. 2 shows the current spikes at the top, the AC mains input voltage in the middle, the voltage across the current source circuit B1 at the bottom. It can be seen that the current spikes and voltage spikes are very large.

Figure 3:
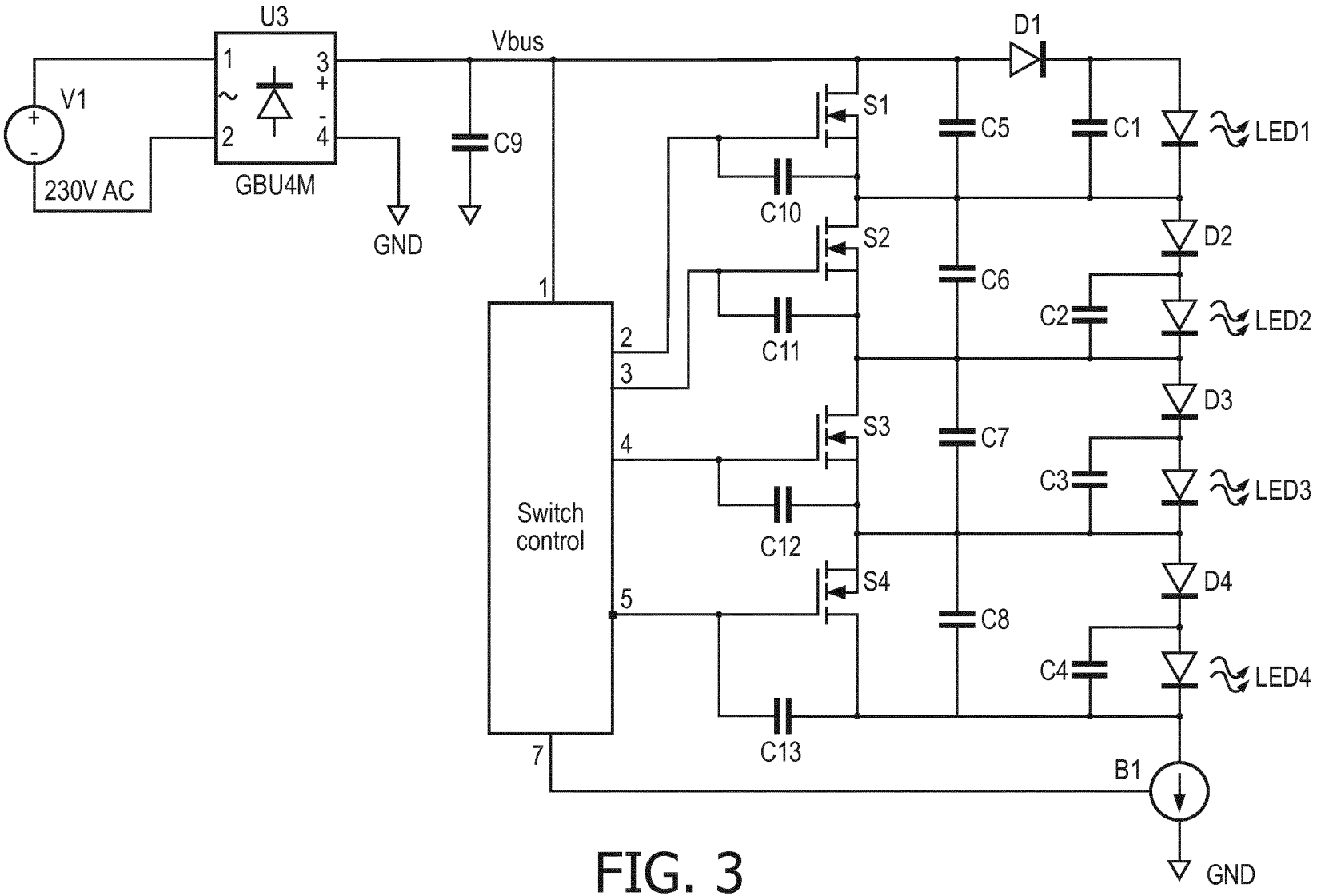
FIG. 3 shows a circuit schematic of another typical tapped linear driver.

Another circuit is showed in FIG. 3, capacitors are added between gate/source and drain/source of MOSFETs S1~S4. For MOSFET S1 as an example, C10 is added between gate and source, and C5 is between drain and source. The circuit lowers the switching speed to overcome current spike and the voltage across the MOSFET is clamped by the capacitor C5 thus there is no transient voltage change on the current source circuit B1, making the current spike less. However it brings some of side effects: lower efficiency as energy stored in capacitors C5 to C8 is consumed by MOSFETs; and crossing switching between MOSFETs affect input current shape, reduce THD and PF performance.

A basic embodiment of the invention proposes a buffer component connected to an anode and a cathode of a series string of at least two LED segments. This buffer component buffers a voltage across the at least two LED segments when the switches of the at least two LED segment are open, and discharges via one switch of one LED segment and the other LED segment when the switch of the one LED segment closes while the switch of the other LED segment is still open. Thus the voltage across the at least two LED segments is stabilized to prevent voltage/current spikes, and energy discharged by the buffer component still flows through the other LED segment and the efficiency is high.

Figure 4:
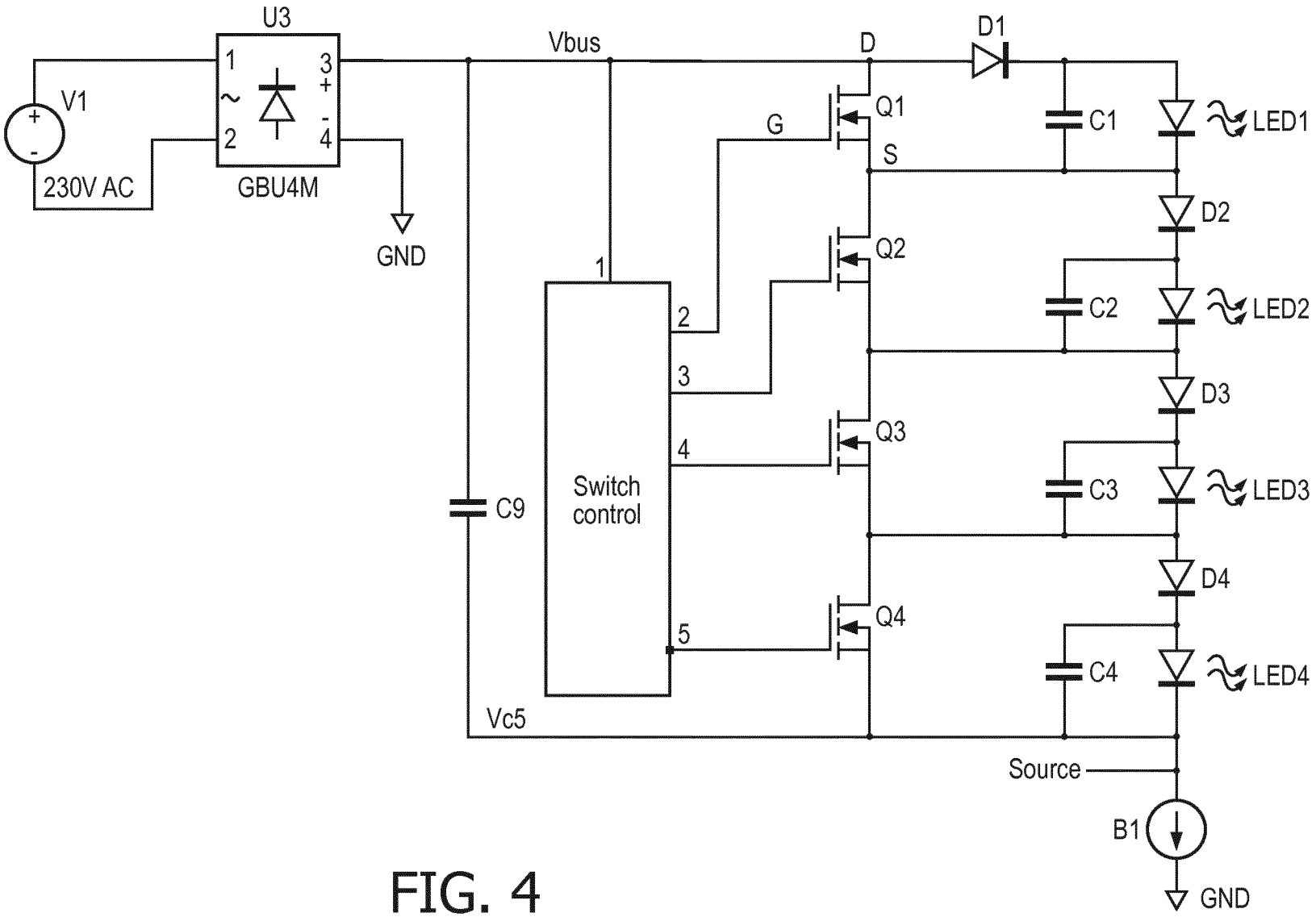
FIG. 4 shows a circuit schematic of a tapped linear driver according a basic embodiment of the invention.

More specially, as shown in FIG. 4, the capacitor across the drain and source of the MOSFETs are removed, such that their discharging loss is prevented. A capacitor C9 is added to connect the anode and cathode of the series string of all LED segments LED1 to LED4 with respective switches Q1 to Q4. Alternatively, the capacitor C9 can connect to the anode and cathode of a series string of only two or three of the LED segments', for example LED1 and LED2, LED2 and LED3, or LED3 and LED4, or LED1, LED2 and LED3, or LED2, LED3 and LED4.

Let Q1 to Q4 are all turned off when the instantaneous amplitude of the AC mains voltage is at peak. As the amplitude goes down, Q1 is switched from off to on to bypass the LED segment LED1. At the point of switching, the input voltage is considered to be constant. C9 keeps the voltage from the positive output of the rectifier to the cathode of the LED segments. Thus the voltage across the current source circuit B1 is also kept. There is no voltage/current spike. C9 is discharged though the pass:

Q1-DS→D2→C2//LED2→D3→C3//LED3→D4→C4//LED4→D5

Wherein DS means from drain to source, and//means parallel connection.

The discharging current drives the LED segments LED2 to LED4 thus the embodiment has a higher efficiency than the circuit in FIG. 3 wherein the discharging current of C5 is totally consumed by a MOSFET.

Figure 5:
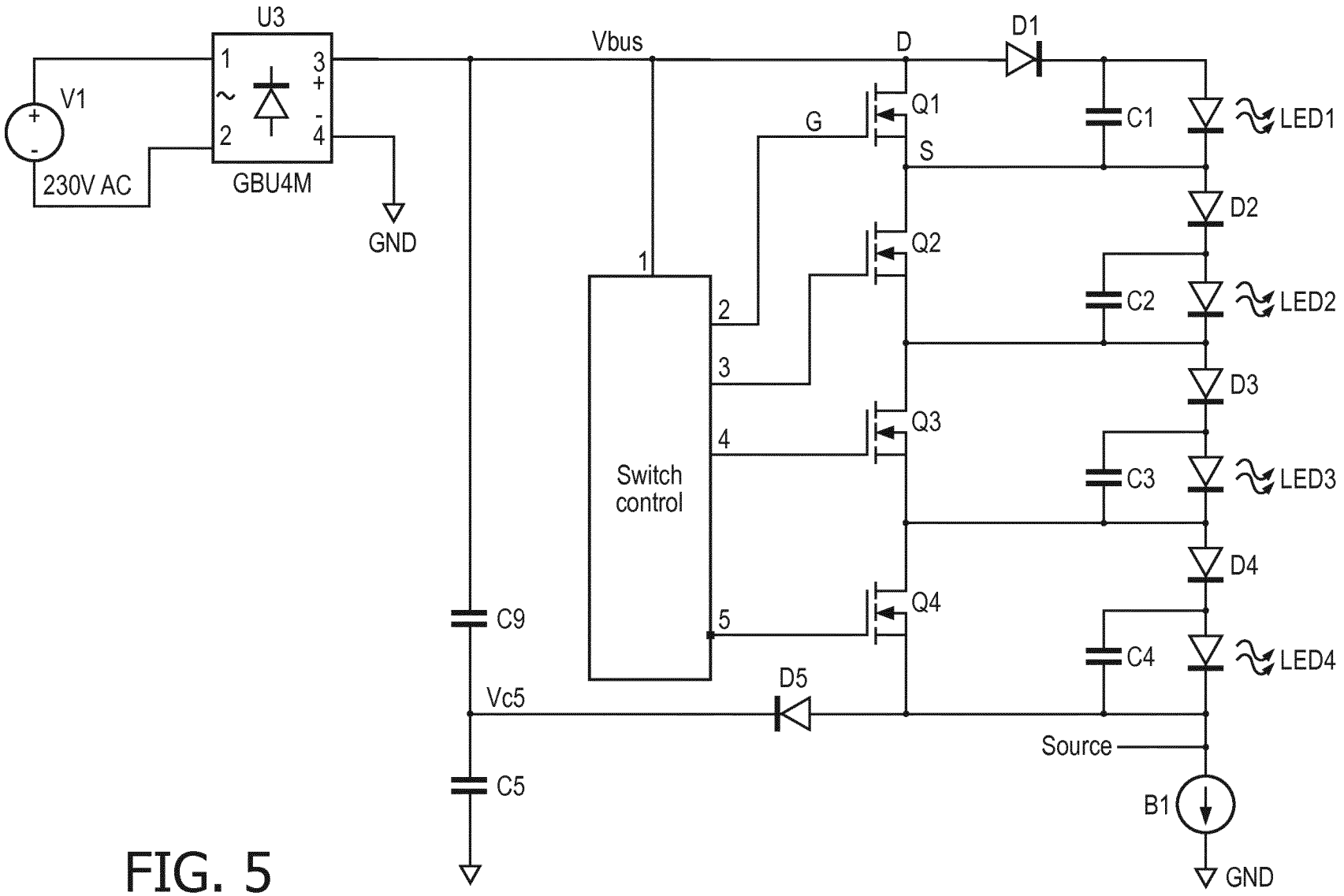
FIG. 5 shows a circuit schematic of a tapped linear driver according an improved embodiment of the invention.

A further embodiment is adding a further buffer component in parallel with the current source circuit. As shown in FIG. 5, a further buffer component C5 is provided across the current source circuit B1. The buffer component C9 and the further buffer component C5 is in series connection, between the (rectified) input voltage. It further comprises a diode forwarded from the cathode of the series plurality of LED segments to an interconnection of said buffer component C9 and the further buffer component C5.

The voltage across the current source circuit is also stabilized by the capacitor C5. In case the MOSFET is turned on, the voltage across the current source circuit intends to increase but it will be first clamped by C5's voltage plus the forward voltage of D5.

C5 is discharged though the pass:

C9→Q1-DS→D2→C2//LED2→D3→C3//LED3→D4→C4//LED4→B1

During Q1 switching, the voltage drop on LED1 will be applied to B1'S source point in very short time.

$$V_{source1}=V_{bus}-V\text{led1}-V\text{led2}-V\text{led3}-V\text{led4} \quad (1)(\text{Q1}\sim\text{Q4 off})$$

$$V_{source2}=V_{bus}-V_{Rdson}-V\text{led2}-V\text{led3}-V\text{led4} \quad (2)(\text{Q1 on,Q2}\sim\text{Q3 off})$$

By Equation 2-Equation 1, we can gain the voltage changing on B1 during Q1 turning on.

$$\Delta V_{source}=V_{led1}-V_{Rdson} \quad (3)$$

B1 is linear current source, the resistance of B1 at the period of Q1 turning on can be calculated by equation (4).

$$R_{B1}=V_{source1}/I_{in} \quad (4)$$

The current delta during Q1 turning on:

$$I_{peak}=\Delta V_{source}/R_{B1} \quad (5)$$

The spike Ipeak is calculated by equation 5. This spike current make EMI, THD worse. Furthermore, it produce oscillating between pins of Q1 which reduce hi-pot performance.

Without C9 the response speed of B1 is much slower than turning on speed of Q1. With C1, we can see ΔVsource across the current source is reduced, RBI is increased. Obviously Ipeak changed smaller, input current become smooth (green channel in FIG. 7). For the circuit we choose C9 330 nF, and C5 33 nF. During discharging of C9, the energy is almost all consumed by led. Also with help of D9, no extra power stored in cap C9, and C5 consumed by B1. So efficiency is high.

Figure 6:
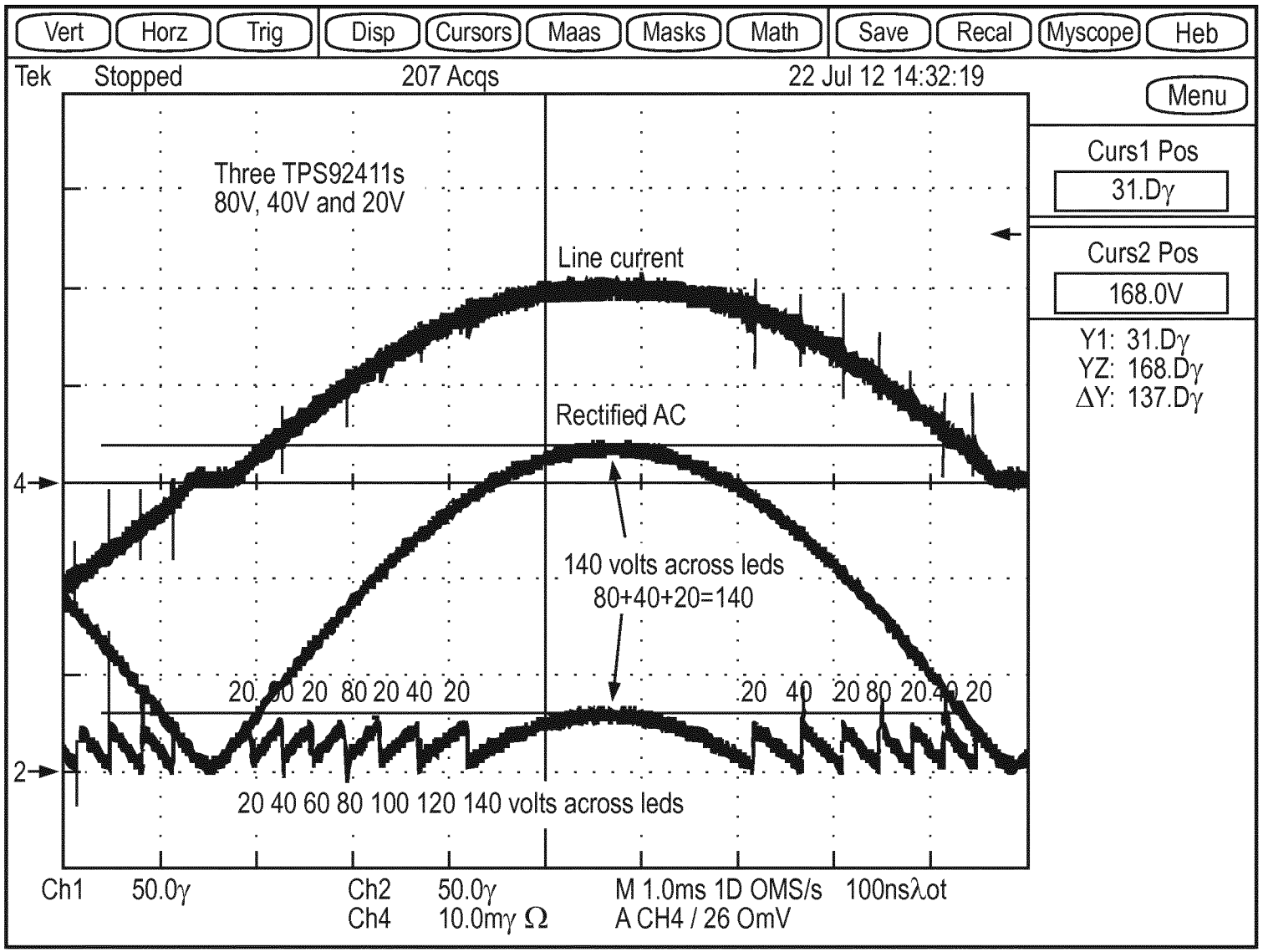
FIG. 6 shows the input current waveform of the circuit in FIG. 5.

FIG. 6 shows the input current waveform of the embodiment in FIG. 5. It can be seen that the current spikes are much fewer than those in FIG. 2.

The current source circuit can be implemented by bipolar transistor or MOSFET. Variations to the disclosed embodiments can be understood and effected by those skilled in the art in practicing the claimed invention, from a study of the drawings, the disclosure and the appended claims. For example, the current source circuit can be moved from the cathode of the LED segments to the anode of the LED segments, namely a high side driving. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A light emitting diode (LED) lighting circuit, comprising an input adapted to receive an input voltage via a rectifier, a plurality of LED segments are in series connection and connected to the input, a buffer component connected to an anode and a cathode of a series string of at least two of the plurality of LED segments;

a current source circuit in series connection with the at least two LED segments and the input, and the current source circuit is in parallel connection with the buffer component and further comprising a further buffer connected component across the current source circuit (B1), wherein said buffer component and the further buffer component is in series connection between the input, and said buffer component is in parallel connection with the current source circuit.

2. The LED lighting circuit according to claim 1, further comprising a switching arrangement comprising a plurality of switches, each of the switches is connected in parallel with a respective LED segment to selectively bypass none or at least one LED segment so as to match the forward voltage of the rest of the plurality of LED segments with an instantaneous amplitude of the input voltage.

3. The LED lighting circuit according to claim 2, wherein said buffer component comprises a capacitor, said capacitor is adapted to buffer a voltage across the at least two LED segments when the switches of the at least two LED segment are open, and discharge via one switch of one LED segment and the other LED segment when the switch of the one LED segment closes while the switch of the other LED segment is still open.

4. The LED lighting circuit according to claim 2, wherein said buffer component (C9) is adapted to stabilize a voltage across the at least two LED segments, thereby stabilizing a voltage across the current source circuit, when a switch of the at least two LED segments is switched.

5. The LED lighting circuit according to claim 2, wherein the input comprises a positive terminal to connect the anode of the series plurality of LED segments, and a negative terminal to connect, via the current source circuit, the cathode of the series plurality of LED segments, and the buffer component is connected across the anode and the cathode of the series plurality of LED segments.

6. The LED lighting circuit according to claim 2, wherein said switching arrangement is adapted to:

not bypass a first LED segment and bypass a second LED segment when the instantaneous amplitude of the input voltage is in a first range;

bypass the first LED segment and not bypass the second LED segment when the instantaneous amplitude of the input voltage is in a second range higher than the first range; and not bypass the first LED segment and the second LED segment when the instantaneous amplitude of the input voltage is in a third range higher than the second range.

7. The LED lighting circuit according to claim 1, further comprising a diode forwarded from the cathode of the series plurality of LED segments to an interconnection of said buffer component and the further buffer component.

8. The LED lighting circuit according to claim 1, further comprising a plurality of capacitors, each of the capacitors is connected in parallel with one LED segment respectively, and a plurality of diodes, each of the diodes is connected between one switch and one capacitor to block a discharge of the capacitor via the switch such that the current flowing terminals of the switch is decoupled from discharging energy of that parallel capacitor.

9. The LED lighting circuit according to claim 1, wherein the input is adapted to receive a rectified AC mains voltage as the input voltage.

10. A lighting device comprising the LED lighting circuit according to claim 1.

* * * * *